US005318299A

United States Patent [19]

Beaster et al.

[11] Patent Number: 5,318,299

[45] Date of Patent: Jun. 7, 1994

[54] CARD GAME BOARD

[76] Inventors: Warren L. Beaster, 10973 SW. 81 Ave., Ocala, Fla. 34481-9675; George Spector, 233 Broadway Rm 702, New York, N.Y. 10279

[21] Appl. No.: 27,877

[22] Filed: Mar. 9, 1993

[51] Int. Cl.[5] ..... A63F 1/06

[52] U.S. Cl. ..... 273/148 R; 273/280; 273/287; 273/309; 108/139

[58] Field of Search ..... 273/280, 287, 309, 148 R, 273/148 A, 274; 108/139

[56] References Cited

U.S. PATENT DOCUMENTS

| | | | |
|---|---|---|---|
| 104,010 | 6/1870 | Yeamans | 108/139 |
| 462,933 | 11/1891 | Sanderson et al. | 273/280 |
| 2,052,801 | 9/1936 | Russakov | 108/139 |
| 3,011,789 | 12/1961 | Eliassen et al. | 273/287 |
| 3,503,523 | 3/1970 | Hamilton et al. | 108/139 |
| 3,840,236 | 10/1974 | Beskrone | 273/280 |
| 5,149,043 | 9/1992 | Grundmann | 108/139 |

FOREIGN PATENT DOCUMENTS

| | | | |
|---|---|---|---|
| 115186 | 11/1899 | Fed. Rep. of Germany | 273/309 |

*Primary Examiner*—Benjamin H. Layno

[57] ABSTRACT

A rotatable betting device is provided for a card game which consists of a turntable assembly to sit upon a flat surface. A plurality of cups are radially positioned about the turntable assembly, so that each card player can conveniently place bets by inserting chips into their respective cup during the card game.

2 Claims, 1 Drawing Sheet

CARD GAME BOARD

BACKGROUND OF THE INVENTION

The instant invention relates generally to card game equipment and more specifically it relates to a rotatable betting device for a card game, which provides a turntable supporting cups for people to place their bets into during a card game.

There are available various conventional card game equipment which do not provide the novel improvements of the invention herein disclosed.

SUMMARY OF THE INVENTION

A primary object of the present invention is to provide a rotatable betting device for a card game that will overcome the shortcomings of the prior art devices.

Another object is to provide a rotatable betting device for a card game that includes a turntable assembly for supporting a plurality of radially position cups, so that people can conveniently place their chips into the cups when betting during the card game.

An additional object is to provide a rotatable betting device for a card game in which each cup contains a cushion insert to reduce noise when the chips are dropped into the cups.

A further object is to provide a rotatable betting device for a card game that is simple and easy to use.

A still further object is to provide a rotatable betting device for a card game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
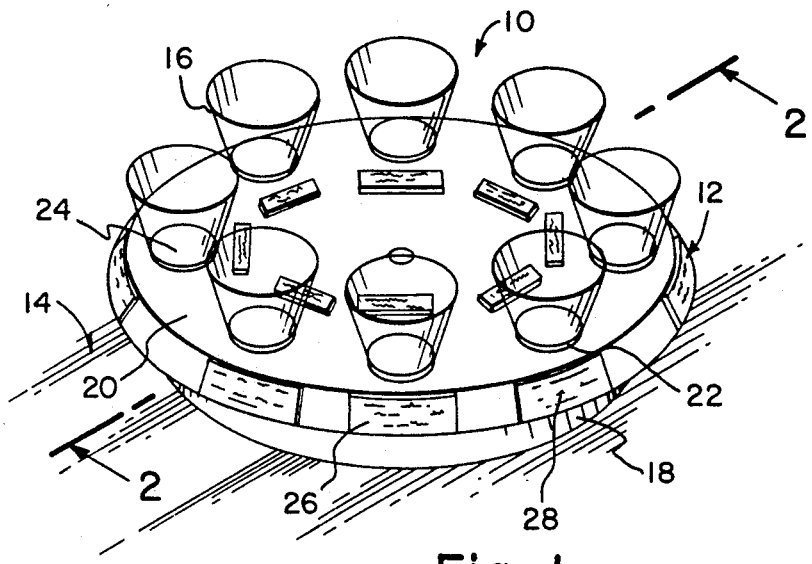
FIG. 1 is a perspective view of the instant invention.
Figure 2:
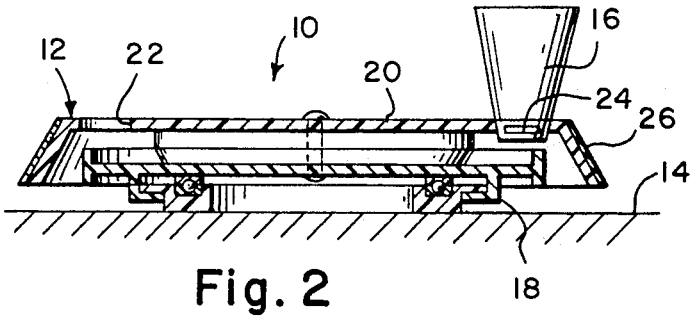
FIG. 2 is a cross sectional view taken along line 2—2 in FIG. 1.

Turning now descriptively to the drawings, in which similar reference characters denote similar elements throughout the several views, FIGS. 1 and 2 illustrate a rotatable betting device 10 for a card game which consists of a turntable assembly 12 to sit upon a flat surface 14, such as a table top. A plurality of cups 16 are radially positioned about the turntable assembly 12, so that each card player can conveniently place bets by inserting chips into their respective cup 16 during the card game.

The turntable assembly 12 contains a base unit 18 and a revolving tray 20, connected to the base unit 18. The revolving tray 20 has a plurality of apertures 22, which are radially spaced thereabout, so that the cups 16 can securely sit within the apertures 22.

The rotatable betting device 10 further includes a plurality of cushion inserts 24, each placed into each cup 16, so as to reduce noise when the chips are dropped into the cups 16 during the card game. A plurality of identification cards 26 are also provided. Each have different indicia 28 thereon and are affixed to the revolving tray 20 adjacent to each cup 16, so as to identify each cup 16 for each card player.

Figure 3:
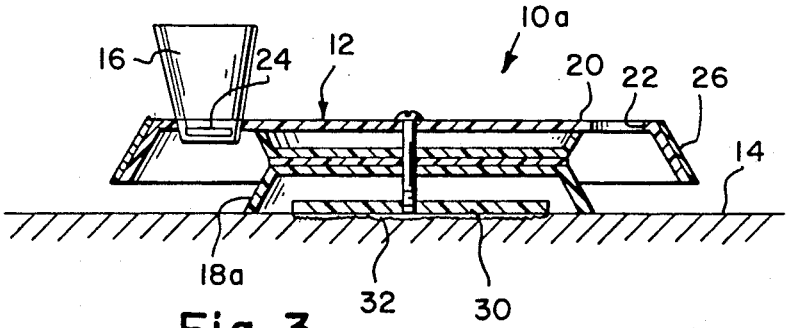
FIG. 3 is a modification in which a bearing plate is provided for engaging a flat surface to prevent slippage on the flat surface.

A modified rotatable betting device **10*a*, as shown in FIG. 3, wherein the base unit 18*a* includes a bearing plate 30 having a serrated bottom end 32, for engaging the flat surface 14, so as to prevent slippage on the flat surface 14**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A rotatable betting device for a card game which comprises:

a) a turntable assembly to sit upon a flat surface;

b) a plurality of cups radially positioned about said turntable assembly, so that each card player can conveniently place bets by inserting chips into their said respective cup during said card game; wherein said turntable assembly includes:

c) a bottom support with a flat bottom surface;

d) a revolving tray rotatably mounted on said support said revolving tray having an upper external platform with a plurality of apertures which are radially spaced thereabout, so that said cups can securely sit within said apertures; in combination with a lower base rotatably mounted on said bottom support, said lower base being non-rotationaly connected to said tray and engagingly supporting said tray wherein said platform has a downwardly flaring perimeter flange for securing identification cards adjacent each said cup and wherein said lower base and bottom support are recessed and encompassed within said platform.

2. A rotatable betting device for a card game comprising:

a) a turntable assembly adapted to be supported on a flat surface;

b) a plurality of cups radially positioned about said assembly for placing bets by inserting chips in respective cups wherein said assembly includes;

c) a revolving tray with an upper platform with radially disposed apertures to receive and support betting chip cups therein, said tray being rotatably supported on a base that engages said flat surface;

d) a bearing plate adapted to engage said flat surface, said plate being concentrically enclosed in and spaced form said base;

e) a shaft extending upward axially from said plate through said tray having a rotatable connection with said tray; and f) a downwardly flaring flange extending from said tray encircling said base.

* * * * *